United States Patent [19]

Kureth

[11] 4,034,696

[45] July 12, 1977

[54] BOAT STABILIZER

[76] Inventor: Richard L. Kureth, 31742 Sheridan, Garden City, Mich. 48135

[21] Appl. No.: 660,347

[22] Filed: Feb. 23, 1976

Related U.S. Application Data

[60] Continuation of Ser. No. 495,059, Aug. 5, 1974, abandoned, which is a division of Ser. No. 170,769, Aug. 11, 1971, Pat. No. 3,827,389.

[51] Int. Cl.[2] ..... B65H 25/46

[52] U.S. Cl. ..... 115/12 R; 114/144 B; 114/151

[58] Field of Search ..... 115/11, 12 R, 12 A, 115/13, 14, 15; 114/151, 144 B, 122; 60/222, 229

[56] References Cited

U.S. PATENT DOCUMENTS

| | | | |
|---|---|---|---|
| 733,882 | 7/1903 | Taylor | 115/14 |
| 3,176,648 | 4/1965 | Cavero | 115/12 R |
| 3,675,612 | 7/1972 | Pfeiffer | 115/12 R |

FOREIGN PATENT DOCUMENTS

| | | | |
|---|---|---|---|
| 1,194,510 | 6/1970 | United Kingdom | 114/151 |
| 1,130,378 | 10/1965 | United Kingdom | 115/14 |

*Primary Examiner*—Trygve M. Blix
*Assistant Examiner*—Gregory W. O'Connor
*Attorney, Agent, or Firm*—Gifford, Chandler, Sheridan & Sprinkle

[57] ABSTRACT

A boat stabilizer system comprising a pair of nozzles attached permanently or temporarily to a boat to extend beneath the boat adjacent the front and rear so that a pressurized stream of water can be directed through the nozzles in a desired dirction to stabilize the boat against wind and current to prevent drifting.

8 Claims, 10 Drawing Figures

BOAT STABILIZER

This is a continuation of application Ser. No. 495,059 filed Aug. 5, 1974, now abandoned, which was a divisional application of Ser. No. 170,769 filed Aug. 11, 1971 now U.S. Pat. No. 3,827,389.

BACKGROUND OF THE INVENTION

This invention relates to boat stabilizing devices and more particularly to such devices including water jet propulsion means to provide the stabilizing force.

Boats by their very nature are subject to wind and current forces which push them out of position when the occupants wish to maintain a given position for fishing, swimming, or mere relaxation purposes. Anchors will maintain the boat near a desired spot if the wind or current is not too strong, but even a pair of anchors, one at each end of the boat, will not maintain the boat motionless. Allowing the main propulsion system of the boat to idle at low speed cannot by itself maintain the desired position since it cannot effectively oppose a force directed at an angle to the longitudinal axis of the boat.

SUMMARY OF THE PRESENT INVENTION

The present invention provides a boat stabilizing system comprising a pair of nozzles each rotatable 360° about a vertical axis so that forces acting on the boat from any direction can be effectively opposed to maintain the boat substantially motionless. The nozzles are located such that one is adjacent the front and the other is adjacent the rear of the boat. This provides for control in opposing the forces acting on the boat which a single nozzle cannot provide. The nozzles can also be used as a low speed propulsion system by increasing the water velocity to provide enough force to move the boat against the wind, current and drag forces, and by directing the nozzles to thrust the boat in the desired direction.

When the boat is out of the water, or if an obstacle is encountered during use, the nozzles might be damaged if they are mounted in a fixed position extending from the bottom of the boat. Generally, therefore when nozzles of this type are provided either for stabilization or propulsion, they are retractable into the boat hull by manual or power means, but this retraction is not automatic and requires some action by the user who might forget to retract the nozzles and allow them to be damaged.

The system of the present invention includes a counterweight balance which causes the nozzles to pivot upwardly to a position inside the hull opening when there is no water pressure at the nozzles. In this way, the nozzles are always safely tucked away until the pump motor is turned on to direct water through them.

Two embodiments of the present invention are disclosed. In one embodiment, the stabilizer system is built into the boat and is a permanent part thereof. This, of course, is relatively expensive in that it requires modification of the structure of the boat. Recognizing this and the other advantages inherent in a system which can be readily installed and removed from any boat, a portable stabilizer system has also been disclosed.

As indicated above, a major advantage of the present invention is in the location of the nozzles at the front and rear of the boat and the capability of the nozzles to be rotated 360°. This provides substantially better control and stability than devices of the prior art, and provides a system which, although intended primarily for stabilizatioon, can also be used to propel a boat.

Each of the preferred embodiments of the invention comprises a power unit, such as a small internal combustion engine, which drives a pump. The pump takes in water from below the hull of the boat and pumps it through a metering valve into two conduits leading to nozzle units located at each end of the boat. The metering valve allows the flow of water between the front and rear nozzle units to be varied so that the thrust produced by each can be individually varied so that the position of the boat's longitudinal axis can be set as desired. A throttle valve is provided to control the total amount of water being pumped, and thus regulate the total pumping volume available for proportioning between the nozzle units.

The nozzle units are rotatable together about 360° and are controlled by a main steering pulley connected with a steering wheel to be operated by the occupant. The main pulley is connected to nozzle unit pulleys by a single endless cable in such a way that when the steering wheel is rotated the nozzle unit pulleys are each rotated by equal amounts so that the nozzles are rotated in synchronization.

The nozzles in the permanently installed unit are mounted to the bottom of the boat and extend through the hull. The individual nozzles are mounted on a hinge pin so that they can pivot downwardly when the water pressure from the pump impacts the nozzle surface. When no water is being directed at the nozzle, it pivots upwardly into the nozzle housing by the force of a counterweight which is integral with the nozzle casting and which is located on the side of the nozzle opposite the hinge pin.

In the portable unit the nozzle assemblies are temporarily mounted to extend over the sides of the boat with the nozzle unit pulleys positioned so that they can connect with a main steering pulley, preferably in the middle of the boat and supported on a seat of the boat. The nozzle unit pulleys each rotate a tubular nozzle which is connected to the pressurized water stream conduits from the pump. The nozzles extend into the water beneath the hull of the boat.

Further features and details of the invention will become clear to those skilled in the art to which this invention pertains upon reference to the following detailed description

DESCRIPTION OF THE DRAWINGS

The description refers to the accompanying drawings in which like reference characters refer to like parts throughout the several views, and in which.

DESCRIPTION OF THE PREFERRED EMBODIMENTS

Figure 1:
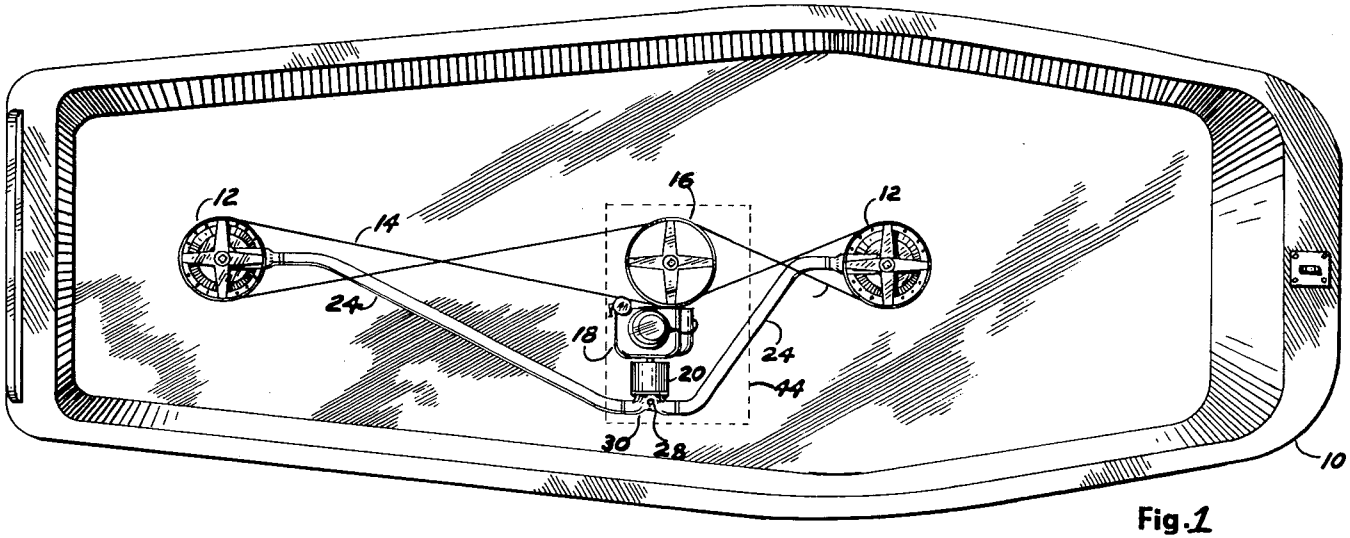
FIG. 1 is a top view of a boat hull showing the installation of one preferred stabilizer unit of the present invention.
Figure 2:
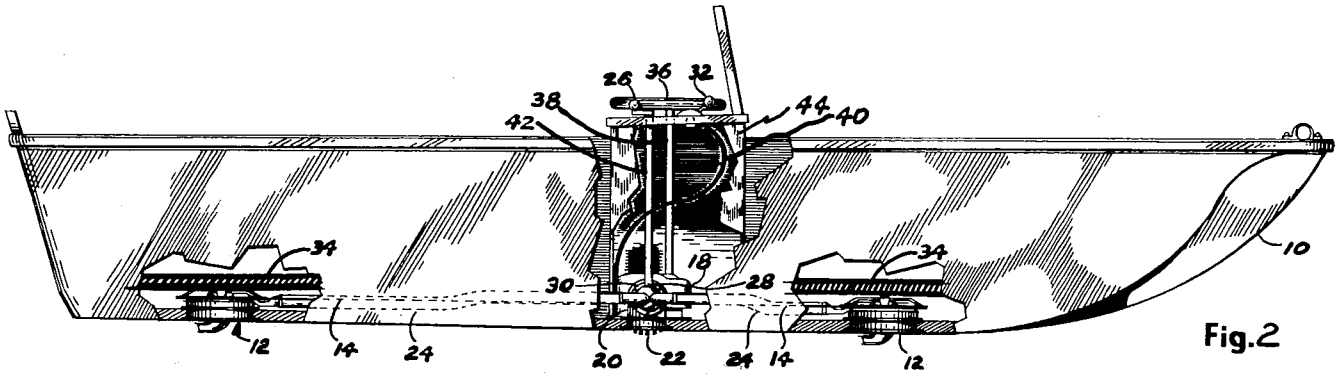
FIG. 2 is a partially cut-away, side view of a boat hull showing the installation of the stabilizer unit of FIG. 1.

Referring to the drawings, FIGS. 1 and 2 illustrate a first embodiment of the present invention as mounted in a boat generally indicated by 10. Shown at 12 are nozzle units connected by a cable 14 to a main steering pulley 16. An internal combustion engine, shown at 18, powers a pump 20, which takes water from below the hull through an inlet 22 as shown in FIG. 2, and pumps it through conduits 24 to the nozzle units 12. A metering valve control 26 (FIG. 2) is provided for manipulating a metering valve 28 inside the pump outlet housing 30 to thereby control the flow of water between the front and rear nozzle units 12. A throttle control, shown at 32 in FIG. 2, regulates the output of the internal combustion engine 18 to thereby control the amount of water pumped through the system.

As also illustrated in FIGS. 1 and 2, the nozzle units 12 are preferably positioned along the longitudinal centerline of the boat 10, with one of the nozzle units positioned near the front of the boat and the other near the rear of the boat. A riased flooring member 34 can be provided as shown in FIG. 2 to cover the nozzle units 12 and the conduits 24. The steering pulley 16 is connected to a steering wheel 36 (FIG. 2) by an upwardly extending shaft 38. The throttle control 32 is connected to the engine 18 by a cable 40, and the metering valve control 26 is connected to the metering valve 28 by a rod 42, so that the controls for the system can be positioned upwardly from the bottom of the boat, as shown in FIG. 2, to provide ease of access. These can be housed in a box structure 44 as shown, which also encloses the engine 18, the pump 20, the steering pulley 16 and the metering valve 28.

Figure 3:
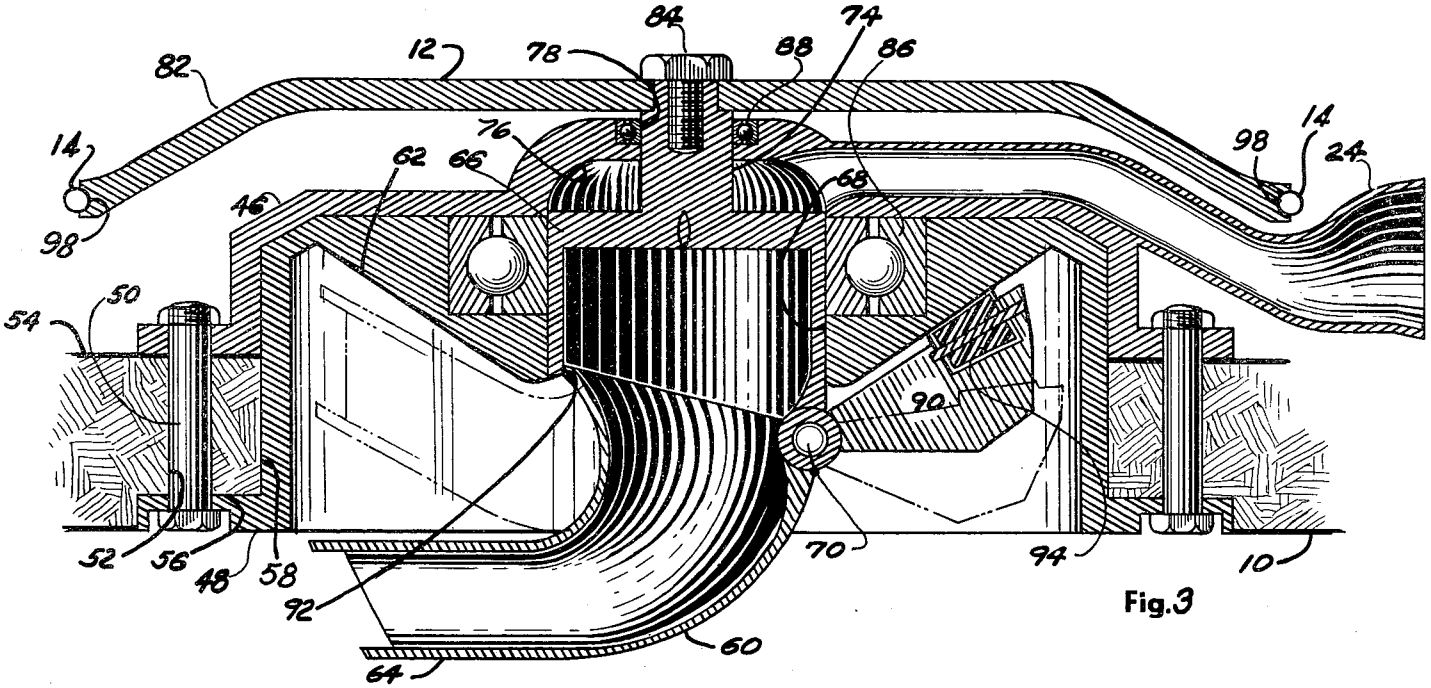
FIG. 3 is an enlarged cross-sectional view of a portion of the structure illustrated in FIGS. 1 and 2.

As can best be seen in FIG. 3, each of the nozzle units 12 preferably comprises an inner support member 46 and an outer housing 48, connected to each other by means of bolts 50 extending through the members 46 and 48 and through holes 52 formed in the hull 54 of the boat 10. The housing 48 fits into a recess 56 formed in the outside bottom of the hull 54 of the boat 10, around an opening 58 through the hull 54 of the boat 10 to provide a flush surface when a nozzle 60 is pivoted upwardly into a chamber 62 formed in the housing 48, as will be further described below. The bolts 50 tightly clamp the two members 46 and 48 of the nozzle units 12 to the hull 54 to provide a waterproof connection of the units to the boat 10.

As can best be seen in FIGS. 3, 4 and 10, each of the nozzles 60 is tubular with a right angle lower portion 64 extending below the hull 54 of the boat 10 when the nozzle 60 is positioned, as shown in solid lines in FIG. 3. An upper portion 66 of the nozzle 60 is received in a cylindrical bore 68 formed through the outer housing 48, and is connected to the lower portion 64 by a hinge 70, so that the lower portion 64 is pivotal about the hinge 70 and with respect to the upper portion 66 between the operating position, shown in solid lines in FIG. 3, to a retracted position, as shown in dashed lines, when the nozzle unit 12 is not in use.

Figure 10:
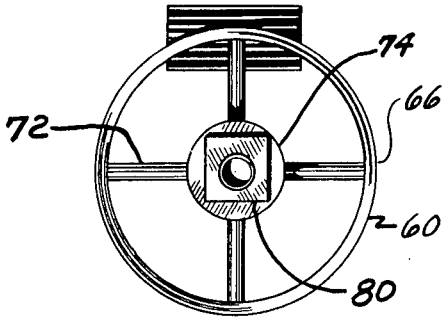
FIG. 10 is a top plan view of a portion of the assemblies illustrated in FIGS. 3 and 9.

As can best be seen in FIG. 10, the nozzle 60 further comprises a plurality of spokes 72, extending radially across the upper portion to a center drive column 74. The drive column 74 extends upwardly through a chamber 76 formed in the inner support member 46, as can best be seen in FIG. 3, and through an opening 78 formed in the inner support member 46. A squared section 80 is formed at the top (FIG. 10) to receive a pulley 82. A bolt 84 secures the pulley 82 to the drive column 74, so tht rotation of the pulley 82 produces a corresponding rotation of the nozzle 60. A groove 98 is maintained about the perimeter of the pulley 82 to receive the cable 14 for rotating the pulley 82. Bearings 86 are preferably provided between the outer housing 48 and the upper portion 66 of the nozzle 60, and similar bearings 88 are provided between the inner support member 46 and the drive column 74 to rotatably support the nozzle 60.

Figure 4:
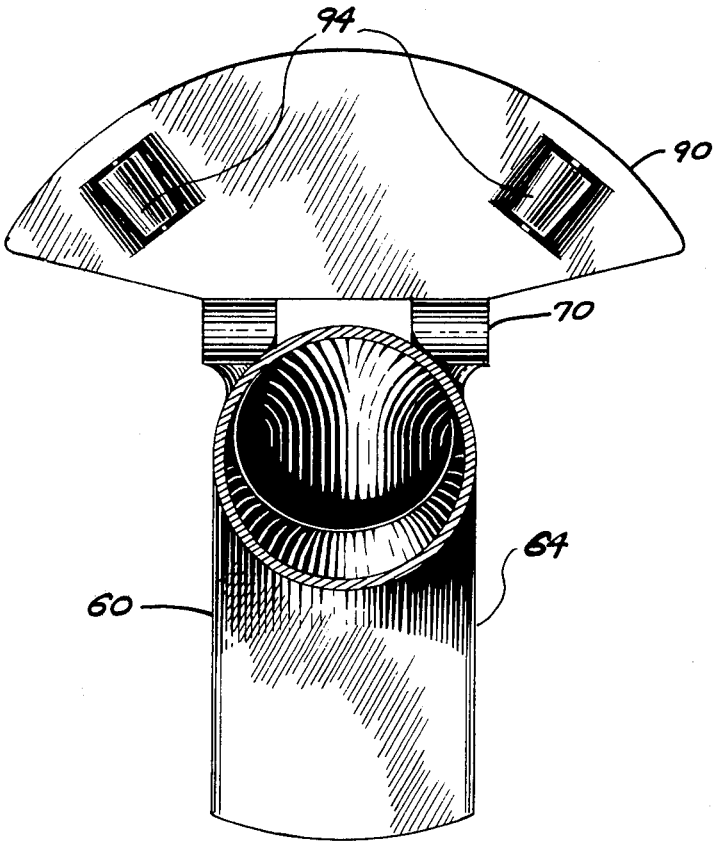
FIG. 4 is an enlarged cross-sectional view of a nozzle unit substantially as seen from the top of FIG. 3 and with structure removed for purposes of clarity.

As can best be seen in FIGS. 3 and 4, a counterweight 90 is carried by the lower portion 64 of the nozzle 60 and extends from the sockets of the hinge 70 as shown. As best seen in FIG. 3, the counterweight 90 is disposed within the chamber 62 when the nozzle 60 is in operating position. The counterweight 90 is of sufficient weight to cause the lower portion 64 of the nozzle 60 to pivot upwardly to the position shown in dashed lines when there is not sufficient water pressure through the nozzles 60 to maintain them in the extended operative position. Thus, when no water pressure is directed to the nozzle units 12 through the conduits 24, the lower portion 64 of the nozzle 60 is pivoted upwardly into the chamber 62, as shown by the dashed lines in FIG. 3, by the downward force of the counterweight 90. However, when water under pressure from the pump 20 is directed to the nozzle units 12, it will push downward on the lower portion 64 of the nozzle 60, causing it to swing downwardly as shown by the solid lines in FIG. 3. In order to prevent the counterweight from contacting the inner surface of the outer housing 48 when the nozzle 60 is in an operating position, the nozzle 60 is so designed that in its full downward position the upper edge of the lower portion 64 of the nozzle 60 contacts the upper portion 66, as at 92, thus limiting the upward travel of the counterweight 90. Or alternatively, bearing bumper means 94 of plastic or the like may be carried by the counterweight 90 to contact the outer housing 48 when the nozzle 60 is in the operating position.

Figure 5:
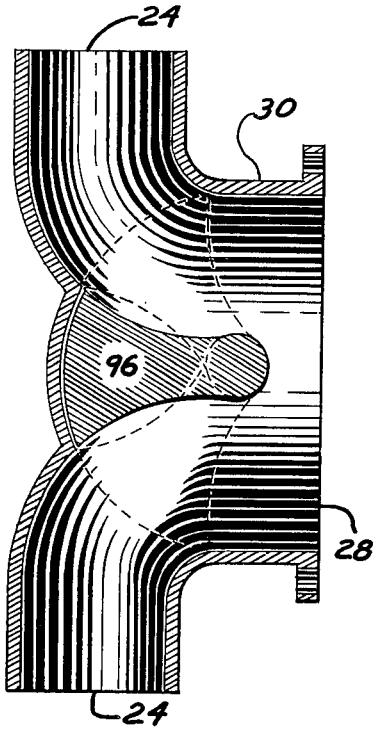
FIG. 5 is a cross-sectional view of the pump outlet housing of the present invention and showing the metering valve located therein.

FIG. 5 illustrates the metering valve 28, located in the pump outlet housing 30, and regulated by the metering valve control 26 (FIG. 1) to proportion the flow of water between the front and rear nozzle units 12. As shown, the metering valve 28 preferably comprises a wedge-shaped rotating member 96 inside a T-shaped junction formed by the pump outlet housing 30 and the two conduits 24 leading to the nozzle units 12. When the member 96 of the metering valve 28 is in the center position shown in FIG. 5, the water stream from the pump 20 is divided equally between the two conduits 24 leading to the front and rear nozzle units 12. By rotating the member 96 of the metering valve 28 to an off-center position, the water flow to one of the conduits 24 may be reduced while the other is increased, thereby providing a control over the flow as between the front and rear nozzle units 12. Thus, it is apparent that by rotating the steering wheel 36 to thereby rotate the nozzle units 12 the nozzles s60 can be positioned in a direction opposite the direction of the force of the current or wind acting upon the boat. The throttle control 32 can be regulated to control the pump 20 to thereby provide a force equal to the forces acting upon the boat. If the forces acting on the front and rear of the boat are different then the metering valve 28 can be required to properly portion the flow of water between the front and rear nozzle units 12 to compensate for this difference. In this way the forces acting upon the boat can be effectively opposed to maintain the boat motionless even in relatively strong current and under strong winds.

The system of the present invention can if desired be used to propel the boat. All that is necessary of course is to increase the pump output by regulating the throttle control 32 to a point where the forces acting upon the boat are overcome. Steering would be accomplished by rotating the nozzles 60 by using the steering wheel 36.

Figure 6:
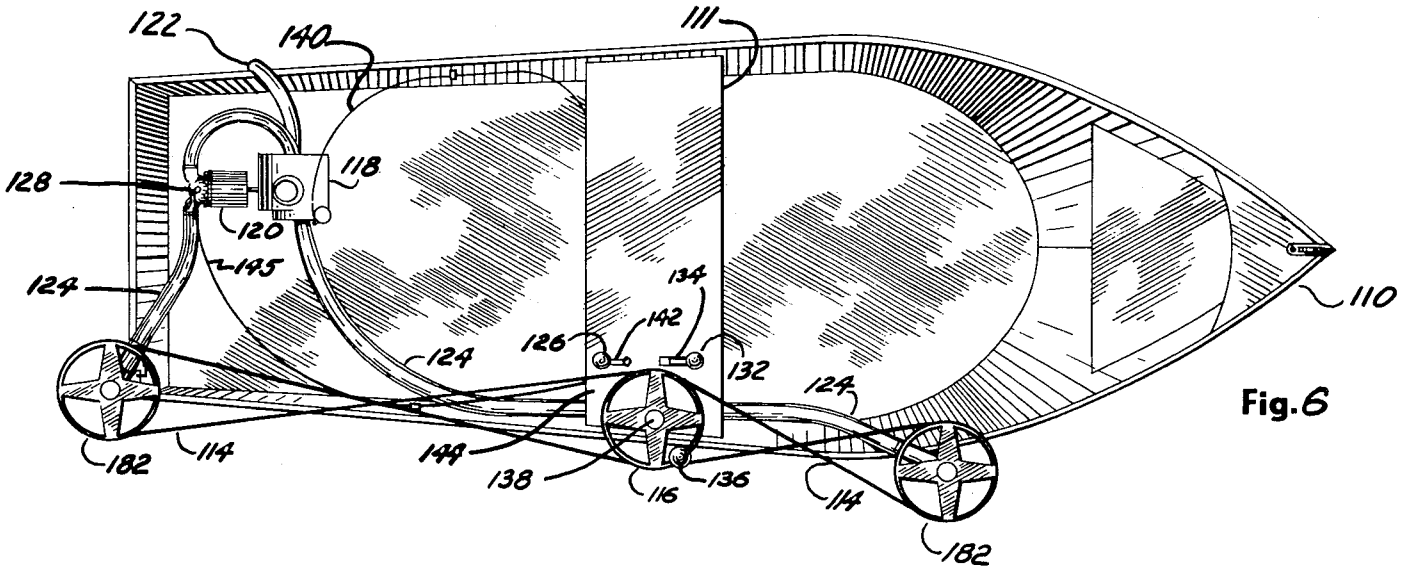
FIG. 6 is a top view of a boat hull illustrating a second embodiment of the present invention.
Figure 7:
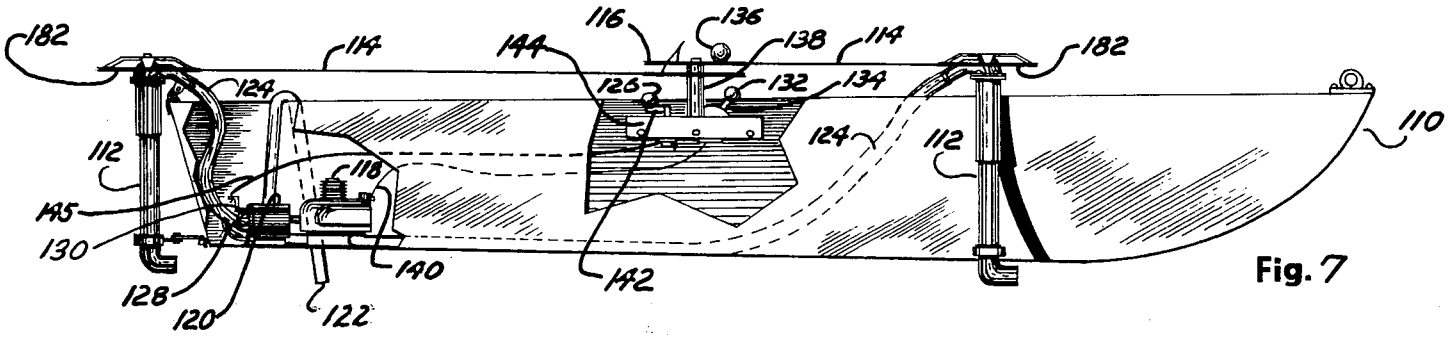
FIG. 7 is a side view of the boat hull illustrated in FIG. 6 with portions removed for purposes of clarity.

Another preferred embodiment of the invention is illustrated in FIGS. 6 and 7. The assembly of this embodiment is adapted to be removably mounted to a boat 110. The power source is a small internal combustion engine 118, which drives a pump 120. The pump 120 takes in water through a tube 122 extending over the side of the boat 110, and pumps it through conduits 124 to nozzle units 112 mounted to the sides of the boat 110. As illustrated in FIGS. 6 and 7, one of the nozzle units 112 is mounted to the side of the boat near the front, while the other is mounted to the rear of the boat. It is apparent, however, that both units could if more convenient be mounted to the same side of the boat or even on opposite sides is this were preferred.

A throttle control 132 regulates the speed of the engine 118 and thereby controls the output of the pump 120. A metering valve control 126 regulates a metering valve 128 in a pump outlet housing 130 in the manner of the operation of the valve 28 described with respect to FIG. 5. The position of the rotatable nozzle units 112 is controlled by a steering pulley 116 connected with nozzle unit pulleys 182 through a cable 114. The controls for the assembly can be mounted to a control box 144 adapted to be positioned on a seat 111 of the boat 110. The steering pulley 116 is carried by a shaft 138, which rotatably supports the pulley 116 and connects it with a steering wheel 136. The throttle control 132 includes a lever 134 mounted to the control box 144 and connected to the throttle of the engine by a cable 140. The metering valve control 126 includes a handle 142 rotatably mounted to the control box 144 and connected to the metering valve 128 by a cable 145.

Figure 8:
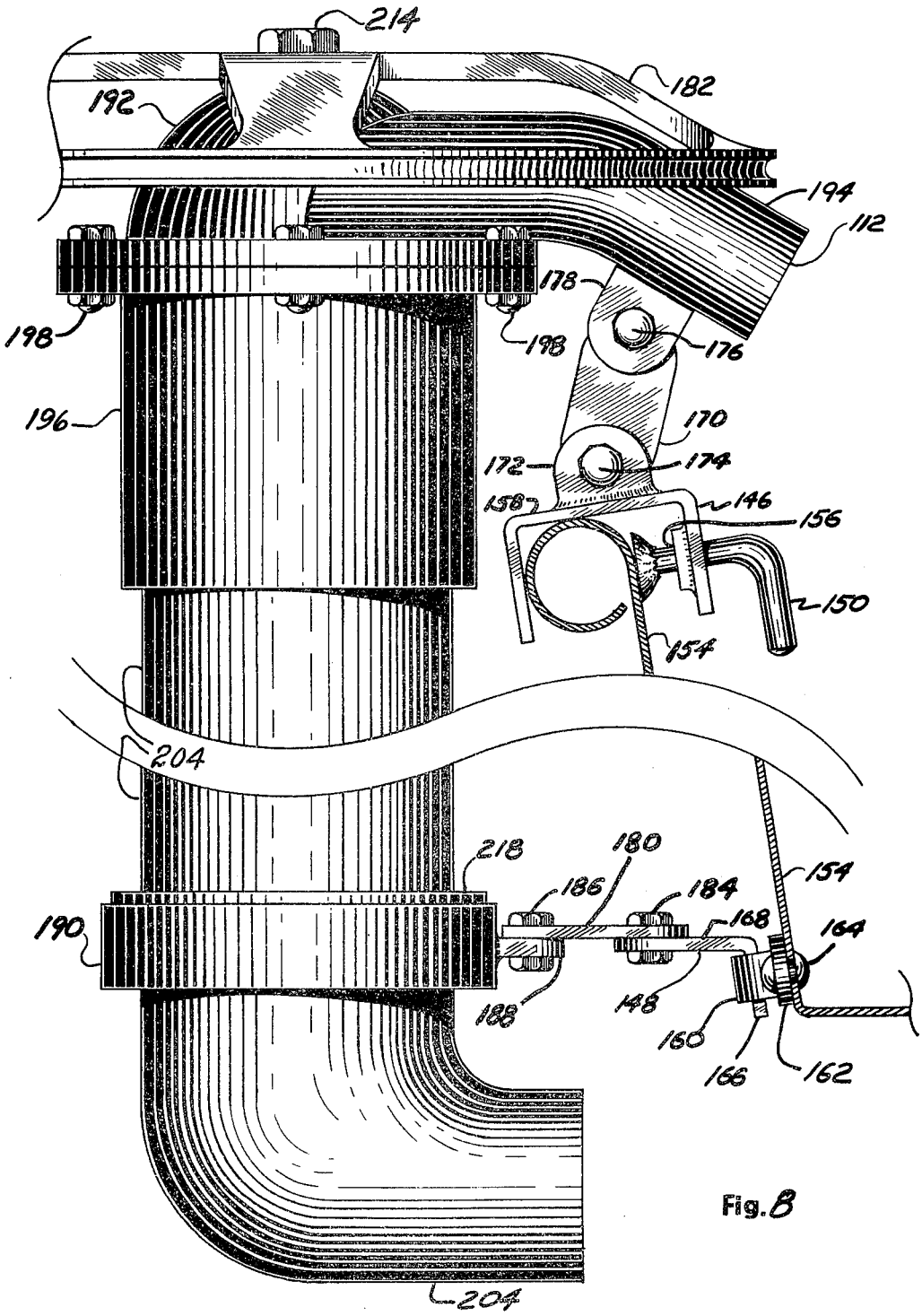
FIG. 8 is an enlarged elevational view of a portion of the structure illustrated in FIGS. 6 and 7.
Figure 9:
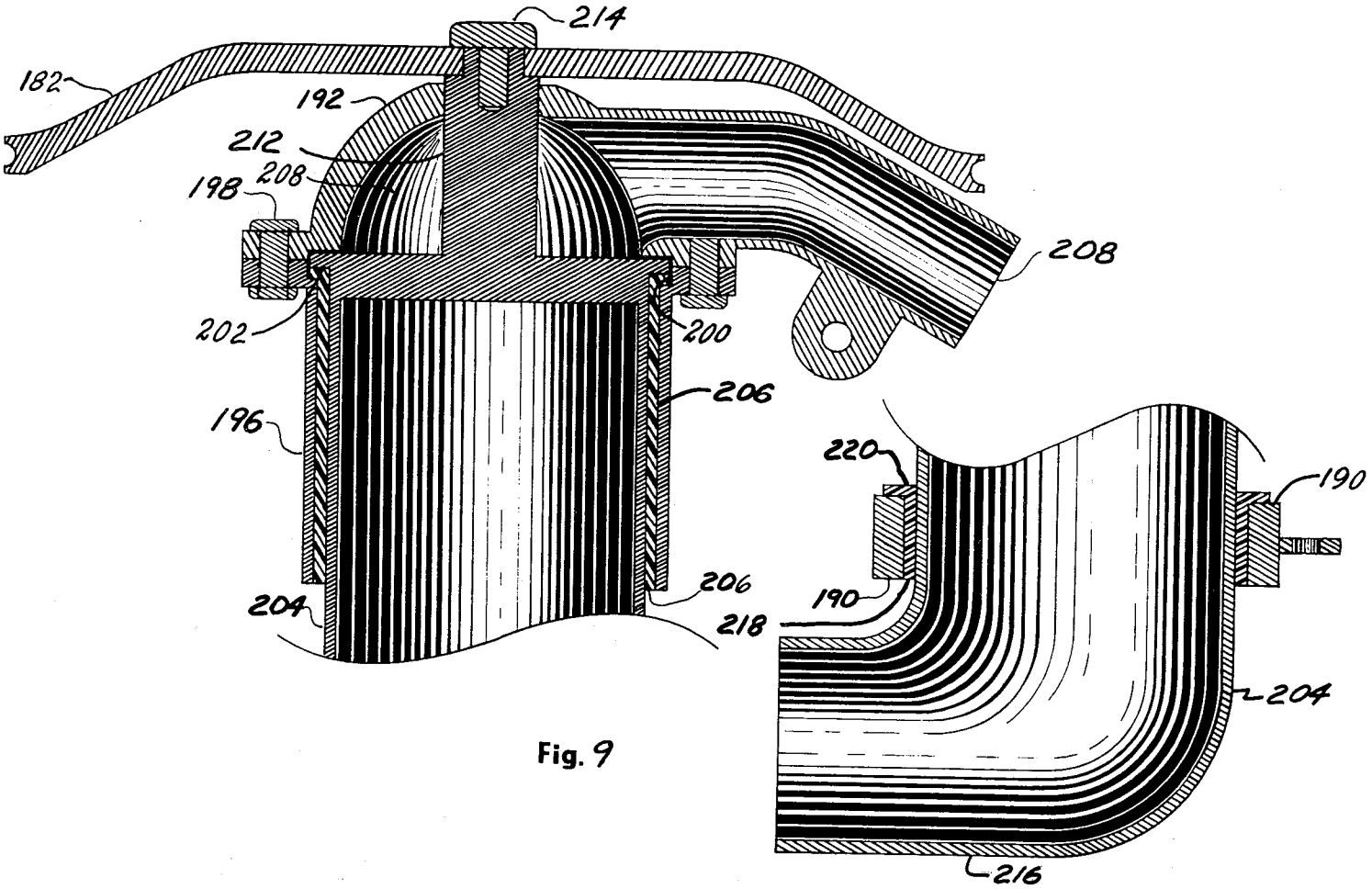
FIG. 9 is a fragmentary cross-sectional longitudinal view of the nozzle unit shown in FIG. 8 with portions broken away for purposes of clarity.

FIGS. 8 and 9 illustrate the details of the nozzle units 112 utilized in the portable embodiment of this invention. The units 112 are attached to one side 154 of the boat 110 by means of a clamp 146 at the top and an eye bracket 148 at the bottom. The clamp 146 is a basic C-clamp which is clamped to the boat 110 by turning a screw-threaded handle 150 into a threaded hole 156 formed in the clamp body 158. The eye bracket 148 comprises a U-shaped member 160 with ears 162 adapted to be mounted to the side 154 of the boat 110 by means of rivets or bolts 164. The U-shaped member 160 receives a downwardly extending portion 166 of a link 168 mounted to the lower portion of the nozzle unit 112 in a manner to be described.

In order to provide a universal mounting for many different hull contours, a system of links is provided between the clamp 146 and the bracket 148 of the nozzle units 112. At the top, a link 170 connects to an upper bracket 172 formed on the C-clamp body 158 by means of a bolt 174. The link 170 in turn connects a bolt 176 to a bracket 178 fixed to the outside wall of the nozzle units 112.

At the bottom, the link 168 is connected to an intermediate link 180 by a bolt 184. The opposite end of the intermediate link 180 is mounted by a bolt 186 to a bracket 188 fixed to a collar member 190 of the nozzle unit 112. The bolts 174, 176, 184 and 186 are left loosened when the nozzle unit 112 is first mounted to the side 154 of the boat 110, then when the proper positioning of the nozzle unit 112 is achieved the bolts 174, 176, 184 and 186 are tightened to securely mount the nozzle units 112 in the proper position.

The nozzle unit 112 preferably comprises an upper housing 192 having an inlet extension 194. The upper housing 192 is preferably bolted to a lower tubular housing 196 by a plurality of bolts 198.

As can best be seen in FIG. 9, the housings 192 and 196 are preferably cut away at their juncture to form an internal groove 200 for receiving an upper, outwardly extending flange 202 of a downwardly extending tubular nozzle member 204. A bushing 206 preferably formed of a flexible, waterproof, low-friction material, such as tatrafluoroethylene, is disposed between the nozzle member 204 and the lower housing 196 to act as a seal and as a bearing member for silent and frictionless rotation of the nozzle member 204 inside the bushing 206. The nozzle member 204 is provided with a plurality of radially extending spokes 210, similar to the spokes 72 of nozzles 60 as shown in FIG. 10. The spokes 210 permit communication between an inlet chamber 208, formed in the upper housing 192 and the interior of the nozzle member 204. The spokes 210 also provide the means for connecting the nozzle member 204 to a drive column 212 which extends upwardly through the chamber 208 and the upper housing 192 to receive the pulley 193, so that rotation of the pulley 193 produces a corresponding rotation of the nozzle member 204. A bolt 214 mounts the pulley 193 to the drive column 212.

The nozzle member 204 extends downwardly below the boat and is provided with a right angle lower portion 216. The collar member 190 encompasses the lower portion of the nozzle member 204 and provides a means for attaching the nozzle unit 112 to the side 154 of the boat 110 by the links 180, as previously described. A bushing 218 of similar material as the bushing 206 is provided between the collar member 190 and the rotatable nozzle member 204 so that a frictionless, stable rotation is achieved. The top of the bushing 218 has a flange 220 extending outwardly over the collar member 190 so that the bushing 218 will not slip out of its position.

It is apparent that the embodiment of FIGS. 6–9 operates substantially the same as the embodiment of FIGS. 1–4. The only difference is that this embodiment is directed to a system which can be readily attached and detached from a boat. This increases the utility of the system substantially and permits its use without requiring modifications in the structure of the boat.

It is also apparent that although I have described several embodiments of my invention, many other modifications and changes can be made in the present invention without departing from the spirit of the invention aexpressed by the scope of the appended claims.

I claim:

1. A stabilizer system for a boat comprising a pair of nozzles mounted to extend below the boat with one of said nozzles positioned adjacent the front of the boat and the other positioned adjacent the rear of the boat, each of said nozzles being provided with an outlet portion extending substantially parallel to the plane of the boat, means for pumping water through said nozzles, means for selectively rotating said nozzles about vertical axis, and means automatically retracting said nozzles into said boat upon nonoperation of said pumping means.

2. The stabilizer system as defined in claim 1 and in which said nozzles extend through the bottom of the boat.

3. The stabilizer system as defined in claim 1 and in which said nozzles are positioned along the longitudinal centerline of said boat.

4. The stabilizer system as defined in claim 1 and in which said last mentioned means comprises said nozzles being hingedly mounted to said boat, and a counterweight attached to each of said nozzles to urge said nozzles to be pivoted upwardly.

5. The stabilizer system as defined in claim 1 and in which said nozzles are rotatably 360°.

6. The stabilizer system as defined in claim 1 and in which said rotating means comprises a pulley mounted to each of said nozzles, a steering wheel, and means connecting said steering wheel to said pulleys, whereby rotation of said steering wheel produces a corresponding rotation of said nozzles.

7. The stabilizer as defined in claim 1 and including means for selectively proportioning flow between said nozzles.

8. A stabilizer system for a boat comprising a pair of nozzles mounted to extend below the boat with one of the nozzles positioned adjacent the front of the boat and the other positioned adjacent the rear of the boat, each of said nozzles being provided with an outlet portion disposed below the boat extending substantially parallel to the plane of the boat, means for pumping water through said nozzles, said pumping means including an inlet disposed intermediate said nozzles, means mounting said nozzles to rotate 360° about a vertical axis, means operable to selectively produce simultaneous rotation of said nozzles and means disposed intermediate said pumping means and said nozzles for selectively proportioning flow between said nozzles said proportioning means comprising a conduit leading from said pumping means, a metering valve connected to said pumping means by said conduit, conduits connecting said metering valve and said nozzles, said metering valve being operable to maintain flow through at least one of said nozzles at all positions thereof and being thereby operable to proportion the flow of water through said nozzles.

* * * * *

UNITED STATES PATENT AND TRADEMARK OFFICE

CERTIFICATE OF CORRECTION

PATENT NO. : 4,034,696

DATED : July 12, 1977

INVENTOR(S) : Richard L. Kureth

It is certified that error appears in the above-identified patent and that said Letters Patent are hereby corrected as shown below:

Abstract, Line 5, delete "dirction", insert --direction--.
Col. 2, line 3, delete "stabilizatioon", insert --stabilization--.
Col. 3, line 32, delete "riased", insert --raised--.
Col. 5, line 8, delete "required", insert --regulated--;
Col. 5, line 34, delete "is", insert --if--.

Signed and Sealed this

*Twenty-fifth* Day of *October 1977*

[SEAL]

*Attest:*

RUTH C. MASON
*Attesting Officer*

LUTRELLE F. PARKER
*Acting Commissioner of Patents and Trademarks*